US011679927B2

(12) United States Patent
Michelot

(10) Patent No.: US 11,679,927 B2
(45) Date of Patent: Jun. 20, 2023

(54) SAFETY DIFFUSER LID FOR AN AEROSOL GENERATOR CONTAINER WITH DEPRESSURIZATION FUNCTION

(71) Applicant: TECHNIMA HOLDING, Nersac (FR)

(72) Inventor: Claude Bernard Michelot, Nersac (FR)

(73) Assignee: TECHNIMA HOLDING, Nersac (FR)

( * ) Notice: Subject to any disclaimer, the term of this patent is extended or adjusted under 35 U.S.C. 154(b) by 25 days.

(21) Appl. No.: 17/441,926

(22) PCT Filed: Mar. 24, 2020

(86) PCT No.: PCT/EP2020/058059
§ 371 (c)(1),
(2) Date: Sep. 22, 2021

(87) PCT Pub. No.: WO2020/193498
PCT Pub. Date: Oct. 1, 2020

(65) Prior Publication Data

US 2022/0194686 A1 Jun. 23, 2022

(30) Foreign Application Priority Data

Mar. 25, 2019 (FR) ..... 1903082
Nov. 16, 2019 (FR) ..... 1913240

(51) Int. Cl.
*B65D 83/20* (2006.01)
*B65D 83/24* (2006.01)
*B65D 83/56* (2006.01)

(52) U.S. Cl.
CPC ..... *B65D 83/205* (2013.01); *B65D 83/24* (2013.01); *B65D 83/56* (2013.01)

(58) Field of Classification Search
CPC ..... B65D 83/208; B65D 83/24; B65D 83/56
See application file for complete search history.

(56) References Cited

U.S. PATENT DOCUMENTS

| | | | | |
|---|---|---|---|---|
| 2,598,308 A | | 5/1952 | Samuels et al. | |
| 3,185,350 A | | 5/1965 | Abplanalp et al. | |
| 3,729,119 A | * | 4/1973 | Sette | B65D 83/24 222/402.11 |
| 3,770,170 A | * | 11/1973 | Hayes | B65D 83/30 222/402.11 |
| 3,844,448 A | | 10/1974 | Sette | |
| 5,649,645 A | * | 7/1997 | Demarest | B65D 83/205 222/153.07 |
| 2017/0362013 A1 | | 12/2017 | Haage | |

FOREIGN PATENT DOCUMENTS

JP 2001055284 2/2001

OTHER PUBLICATIONS

International search report for PCT/EP2020/058059 dated Jul. 3, 2020.

* cited by examiner

*Primary Examiner* — Vishal Pancholi
(74) *Attorney, Agent, or Firm* — Perman & Green, LLP

(57) ABSTRACT

A safety lid for an aerosol container, including a dome surrounding at least part of a diffuser device and provided with a movable component, which can move between a first position for preventing the operation of the diffuser device, a second position for intermittently activating the diffuser device and a third position for emptying the container. The movable component including means for permanently activating the diffuser device in the third position.

16 Claims, 10 Drawing Sheets

SAFETY DIFFUSER LID FOR AN AEROSOL GENERATOR CONTAINER WITH DEPRESSURIZATION FUNCTION

CROSS-REFERENCE TO RELATED APPLICATIONS

This application is a National Stage of International Application No. PCT/EP2020/058059, having an International Filing Date of 24 Mar. 2020, which designated the United States of America, and which International Application was published under PCT Article 21(2) as WO Publication No. 2020/193498 A1, which claims priority from and the benefit of French Patent Application No. 1903082, filed on 25 Mar. 2019 and French Patent Application No. 1913240, filed on 26 Nov. 2019, the disclosures of which are incorporated herein by reference in their entireties.

BACKGROUND

1. Technical Field

The present disclosure relates to a diffuser cap (or spray-cap, and commonly referred to as a cap) for an aerosol generator can (commonly referred to as an aerosol can) provided with a function for depressurizing or emptying the aerosol can on which the cap is mounted.

It is a safety diffuser cap in that it has means for preventing operation of a diffuser.

2. Description of Related Art

The present disclosure relates to the field of aerosol cans and caps for aerosol cans as known for example from document FR2750960 A1 or from document FR3063491 A1. It applies to caps that have a position allowing the activation of a diffuser and a safety position preventing access or blocking this diffuser.

These known solutions are fully accepted by users and offer satisfactory safety of use. However, in the case of technical products such as paints, it appears that sorting and recycling aerosol cans is nowadays tricky due to the fact that a residual amount of product and often flammable gas remains present in the can when a product has been used and therefore emptied of its content. Typically the can contains, after normal use, a minimal residual amount of active product of less than 5 to 10 grams and a flammable residual gas phase with a pressure generally significantly lower than the initial internal pressure (initial pressure approximately 3 to 4 bars depending on the products at 20° C.).

As a result, aerosol cans go to a special waste facility (HHW, hazardous household waste) and are usually incinerated instead of being put to profitable use in a conventional metal recycling facility.

However, the aerosol can is an item of waste essentially composed of metal that is completely recyclable if the precaution is taken to remove the cap, which is itself made of recyclable PP, and to evacuate the residual flammable gas phase, in particular by opening this can (in this case by opening the valve).

SUMMARY

In view of this prior art, the present disclosure provides an improved safety cap for an aerosol can, provided with an emptying position that makes it possible to depressurize the can and to empty the residues of active product without piercing the can.

More precisely, the present disclosure proposes a safety cap for an aerosol can that has a cupola at least partially surrounding a diffuser device, the safety cap being provided with a mobile member, which is able to move between a first position for preventing operation of the diffusion device (diffuser), a second position for intermittent actuation of the diffuser and a third position for emptying the can (depressurization), said mobile member having means for permanent actuation of the diffuser in the third position.

The present disclosure makes it possible to empty the can without any device that is complex to implement (for example piercing the can with special equipment before disposal).

The mobile member can advantageously consist of a rotary dome that is able to move on the cupola, the dome having a diffusion opening at its top and a lateral opening for access to the diffuser in the intermittent actuation position.

According to a particular embodiment, the mobile member has a finger directed toward the inside of the cap and configured to press on a part of the diffuser device in the position for emptying the can.

More particularly, the finger can be configured to press on a pushbutton for operating the diffuser device.

More particularly, the finger consists of a bulge extending a lower part of a central hollow shaft of the dome surrounding a diffusion outlet of a diffuser of the diffuser device.

Advantageously, the mobile member and the cupola are provided with complementary stop means opposing a rotation of the rotary dome in a direction from the position for preventing operation toward the emptying position and leaving the dome free to rotate in the direction from the position for preventing operation toward the intermittent actuation position.

The mobile member and the cupola can be provided with means for realizing a hard point between the intermittent actuation position and the emptying position.

The mobile member and the cupola can be provided with a non-return device opposing a rotation of the dome from the position for emptying the can toward another position.

According to an advantageous embodiment, the mobile member consists of a rotary dome that is able to move on the cupola, the dome having a diffusion opening at its top and a first lateral opening for access to the diffuser device, with the dome in the intermittent actuation position, and the cupola has a button for activating said emptying position that is accessible through a second lateral opening of the dome, with the dome in the intermittent actuation position, said third position being activated by disengagement of a system of stops between the dome and the activation button when the activation button is pressed and rotation of the dome beyond the second position for intermittent actuation of the diffuser device as far as said emptying position.

This improved device makes it possible to avoid unwanted passage into the emptying or depressurization position.

In the context of this improvement, the following features can be implemented independently of one another or in combination with one another.

In order to operate the diffuser device in the emptying position, the dome can have a finger directed toward the inside of the cap and configured to press on a part of the diffuser device in the position for emptying the can.

The finger can be configured to press on a pushbutton for operating the diffuser device.

The finger can consist of a bulge extending a lower part of a central hollow shaft of the dome surrounding a diffusion outlet of a diffuser of the diffuser device.

The system of stops advantageously has, on the activation button, a first stop that can be retracted by pressing the activation button, and, under the dome, a stop tooth positioned such that without pressing the activation button, the retractable stop blocks the passage of the tooth and such that in the event that the activation button is pressed, the retractable stop lets the tooth pass during a rotation of the dome so as to allow the passage of the dome from the intermittent actuation position toward the emptying position.

The dome and the cupola can be provided with a non-return device opposing a rotation of the dome from the position for emptying the can toward the intermittent actuation position.

The non-return device can have a second retractable stop on the activation button, said second retractable stop cooperating with the stop tooth of the dome so as to, with the activation button in the released position, oppose a rotation of the dome in the direction from said emptying position toward said intermittent actuation position.

Advantageously, the activation button is hidden by the dome in said emptying position so as to prevent said button being pressed so as to avoid disengagement of the tooth and of the second retractable stop and a return of the dome toward said intermittent activation position from said emptying position.

The cupola can have a first end stop cooperating with said tooth, with the dome in the position for preventing operation, so as to oppose a rotation of the dome in a direction from the position for preventing operation toward the emptying position and leave the dome free to rotate in the direction from the position for preventing operation toward the intermittent actuation position.

The cupola can have a second end stop cooperating with said tooth, with the dome in the emptying position, so as to oppose a rotation of the dome in the direction from the emptying position toward the position for preventing operation.

The safety cap can have a device with a hard point realized by a stop device with ramps between the dome and the cupola in addition to said system of stops between the dome and the activation button.

The present disclosure further provides an aerosol can equipped with a cap provided with one or more of the features described above.

BRIEF DESCRIPTION OF THE DRAWINGS

Other features, details and advantages will become apparent upon reading the detailed description that describes exemplary aspect of the present application with reference to the appended drawings, which show.

DETAILED DESCRIPTION

The drawings and the description below relate to exemplary aspect that can serve to make the present disclosure easier to understand, but also to contribute to the definition thereof, where appropriate.

The cap described here is designed to be fitted to aerosol generator cans (commonly called aerosols) that in particular contain paints and in particular paints for marking/identification applications (in public works or forestry) in which a circuit for collecting the empty cans exists. Such cans are commonly used for marking/identification applications, in particular for construction sites.

In the cap of the prior art FR2750960 A1, a dome is freely able to move in rotation on a cupola so as to obtain two positions, an open position allowing access to a pushbutton for actuating the diffuser of the can and a closed or safety position preventing access to the pushbutton of the diffuser.

Aerosol cans, when they are considered empty, retain, as seen above, a residual quantity of flammable gas with a residual internal pressure significantly lower than the initial internal pressure of 3 to 4 bars and a remainder of product, and this makes them unsuitable for recycling directly in the metal facility. The present disclosure solves this problem by offering a solution for emptying the can by actuating continuously and definitively under conditions of normal use, i.e. without forcing the device or removing the cap. To do this, the cap of the present disclosure has a third position, called a depressurization or emptying position, that actuates (opens) the valve without the need for an operator to actuate a diffuser continuously or to pierce the can.

Figure 1:
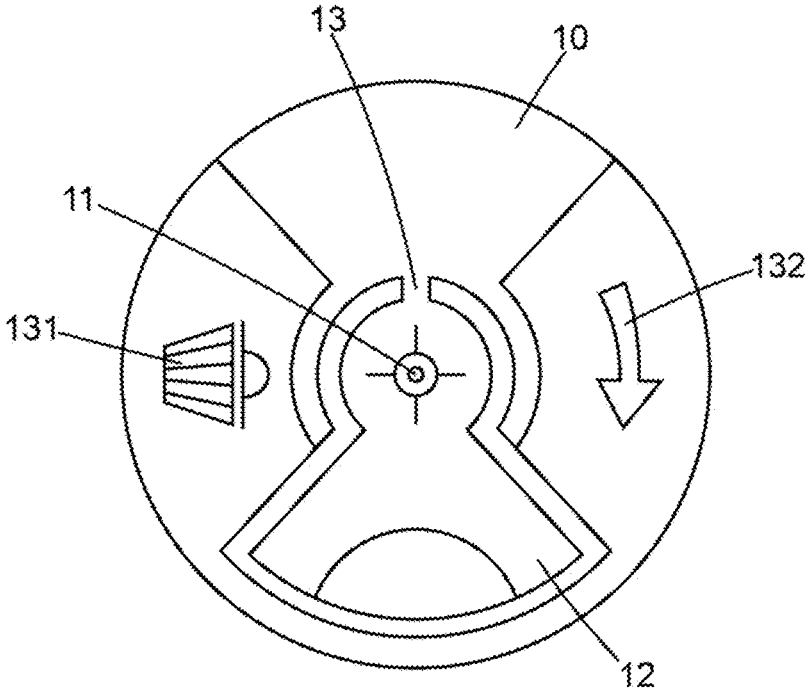
FIG. 1 shows a top view of a first part of a cap according to a first embodiment.
Figure 2:
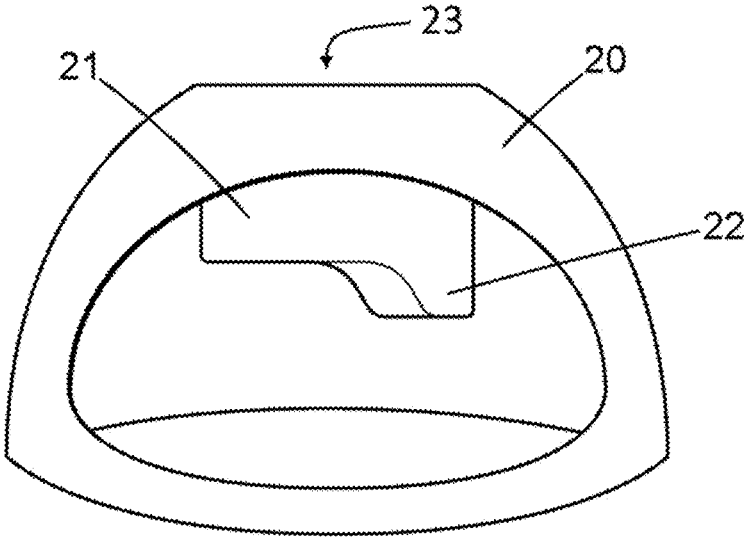
FIG. 2 shows a front view of a second part of a cap according to the first embodiment.

The elements of the cap of the present disclosure as are shown in FIGS. 1 and 2 essentially comprise a cupola 10 and a dome 20. The cupola has two side portions 131, 132 that surround a diffuser device provided with a product outlet diffuser 11 and an operating pushbutton 12, the diffuser device being connected to the cupola by a flexible link 13. The diffuser has a tubular barrel that covers, in a known manner, an outlet tube of the valve of the can, which is not shown. When an operator presses the pushbutton, the diffuser presses on the tube of the valve so as to open the valve and thus cause the product to be sprayed to leave by virtue of the internal pressure of the can in a known manner.

The side portions 131, 132 of the cupola have marks or symbols to depict a safety position and an emptying position.

The dome 20 has an interior surface mating with the exterior surface of the cupola and is mounted so as to be able to rotate on the cupola.

The dome 20 has an opening 23 at its top so as to let the product leave the diffuser, in this case of the axial type, and has a lateral opening 24 so as to allow access to the pushbutton 12 for operating the diffuser in what is called an intermittent actuation position, the actuation being carried out in this case by the operator.

In order to obtain a position for emptying the can, i.e. a position in which the valve is actuated continuously so as to completely empty the can, the dome has a finger 22 that, according to the example, continuously presses on the pushbutton 12 in the emptying position. It should be noted that the present disclosure also applies to a cap in which a finger pushes directly on the diffuser, for example with a lever device between the finger and the diffuser.

The finger shown in FIG. 2 extends the lower part of an anti-spatter hollow shaft 21 of the dome, which surrounds the central opening 23.

In the emptying position, the finger presses irreversibly on the pushbutton 12 of the diffuser so as to open the valve of the can. This allows the aerosol can to be brought to atmospheric pressure by releasing the portion of residual gas still present in the aerosol at the end of use.

Figure 3A:
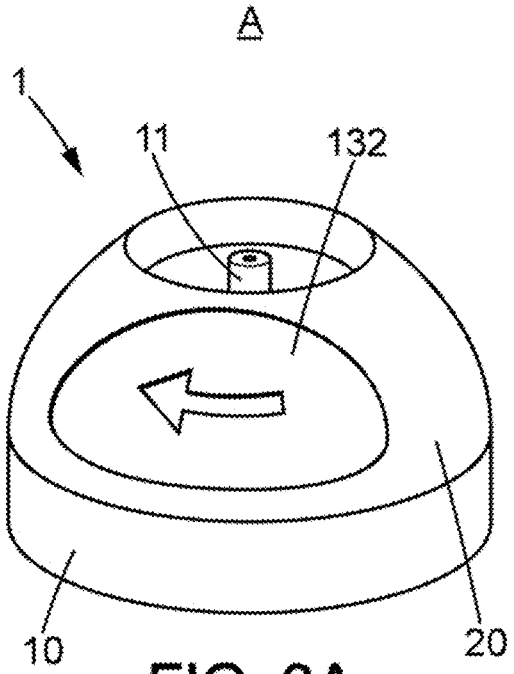
FIG. 3A, FIG. 3B, FIG. 3C show three positions of a cap according to the first embodiment.
Figure 3B:
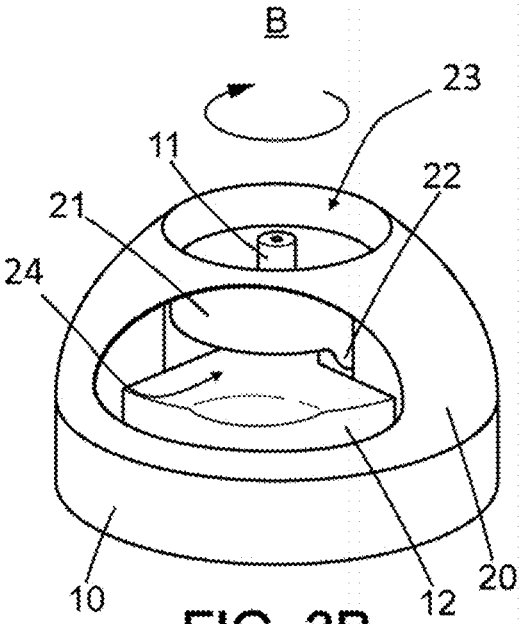
Figure 3C:
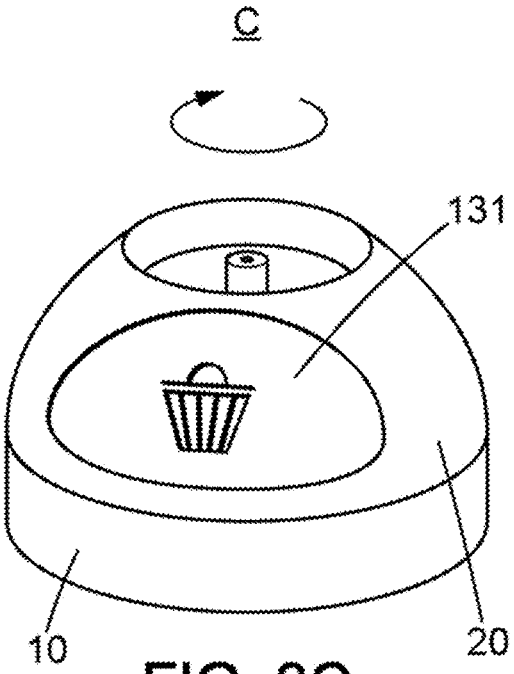

FIGS. 3A to 3C illustrate the three positions of the device, namely, in FIG. 3A the position A for closure or preventing operation in which the pictogram consisting of an arrow on a first side portion 132 of the cupola is visible, in FIG. 3B the position B of use called the intermittent actuation position in which the lateral opening of the dome 24 allows free access to the pushbutton 12 and, in FIG. 3C the position C for emptying the can in which the recycling pictogram on the side portion 131 appears in the lateral opening of the dome, the finger 22, which is not visible, pressing on the pushbutton.

According to the example, the three positions follow each other in a given direction of rotation, for example the clockwise direction of the cap seen from above.

It should be noted that in FIG. 3B, the position B makes it possible to distinguish the finger 22 coming from the hollow shaft 21 waiting near the pushbutton 12.

Figure 4A:
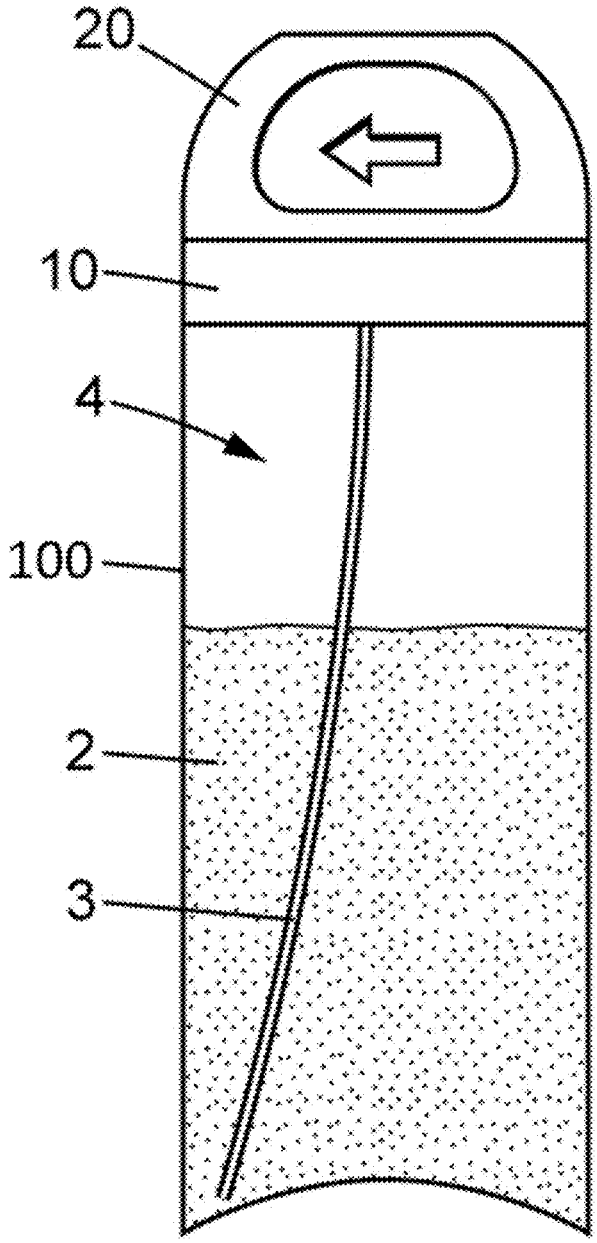
FIG. 4A, FIG. 4B, FIG. 4C, FIG. 4D show transparent side views of an aerosol can equipped with a cap of the first embodiment according to four stages of operation.
Figure 4B:
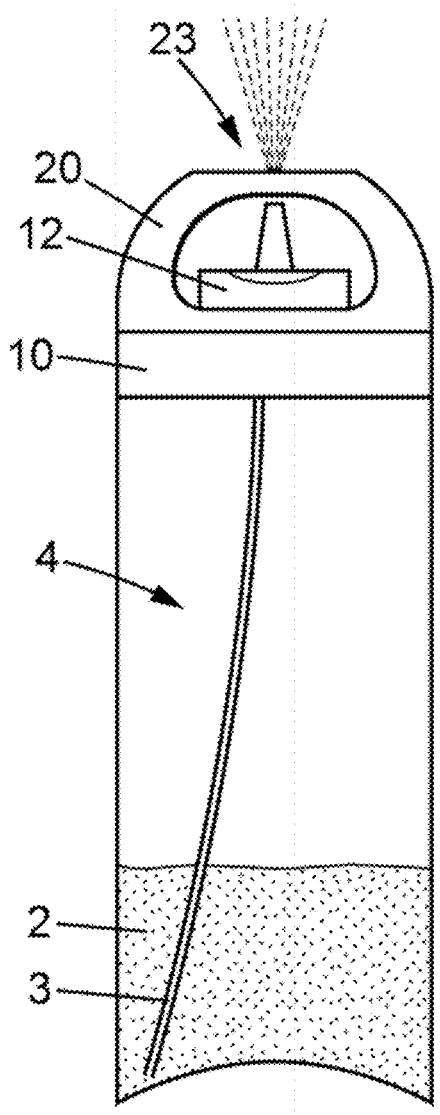
Figure 4C:
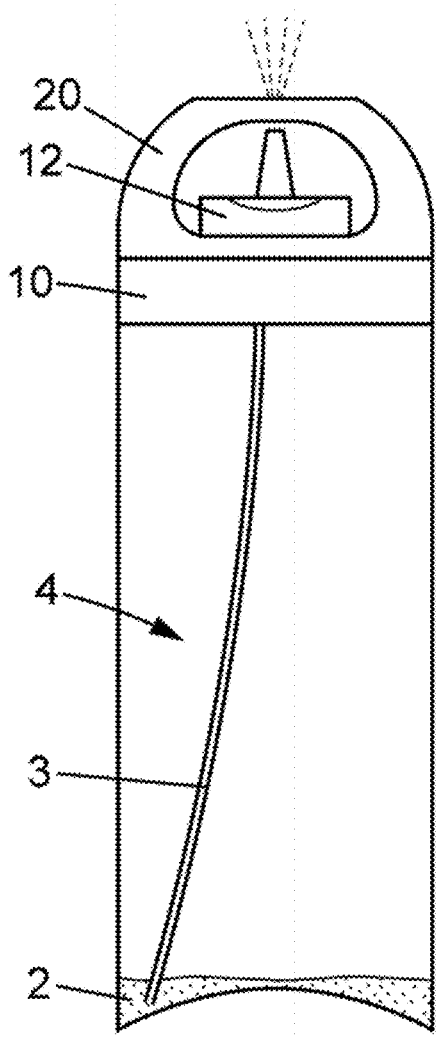
Figure 4D:
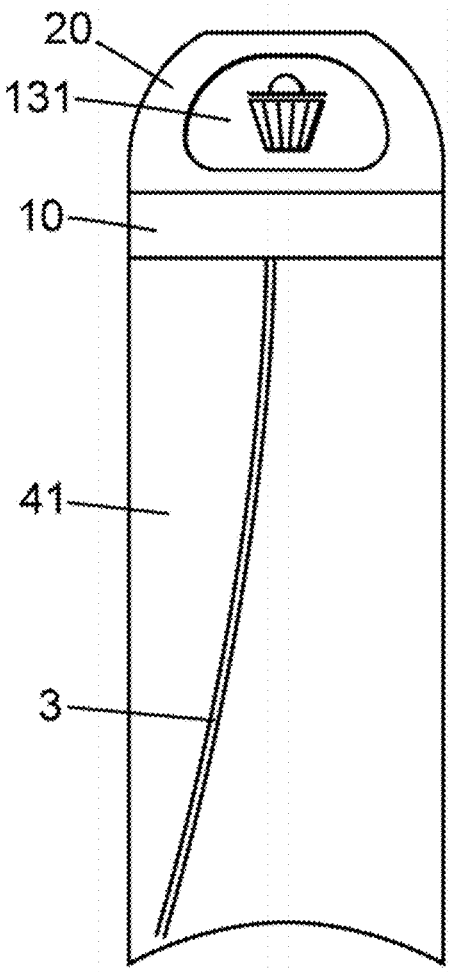

The four phases of use of the cap mounted on a can 100 are shown in FIGS. 4A to 4D. In FIG. 4A, the can 100 is full and has a liquid mixture of product to be sprayed (for example a paint) and of liquefied propellant gas 2, comparable to a co-solvent for the product. When the valve is opened in FIG. 4B, the product, pushed by the pressure of the gas 4, escapes through the collection tube 3 toward the valve and the diffusion outlet 23. In FIG. 4C, the can 100 is practically empty and the product residue and also the gas escapes from the can. The operator can then position the dome in the emptying position according to FIG. 4D, and this empties the gas residue and lets the air 41 enter the can, which becomes inert.

Figure 5A:
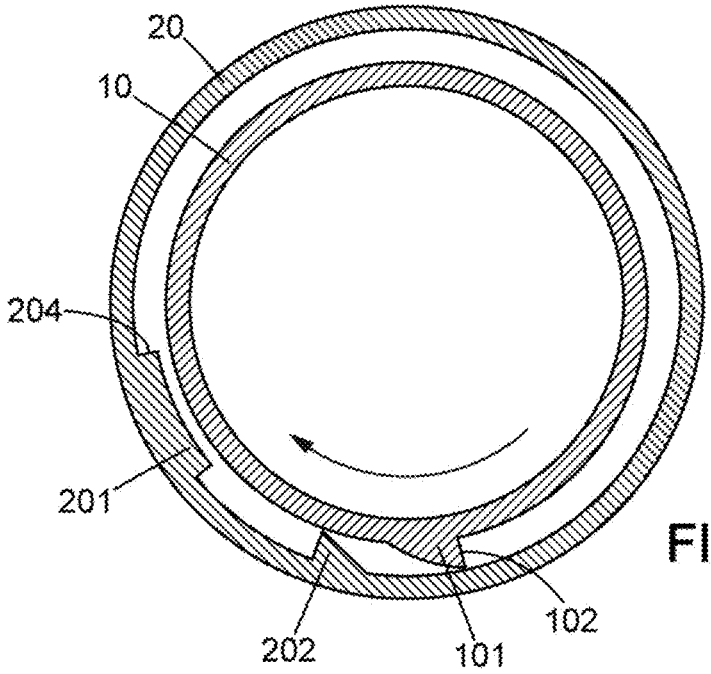
FIG. 5A, FIG. 5B schematically show stop means between two parts of a cap of the first embodiment.
Figure 5B:
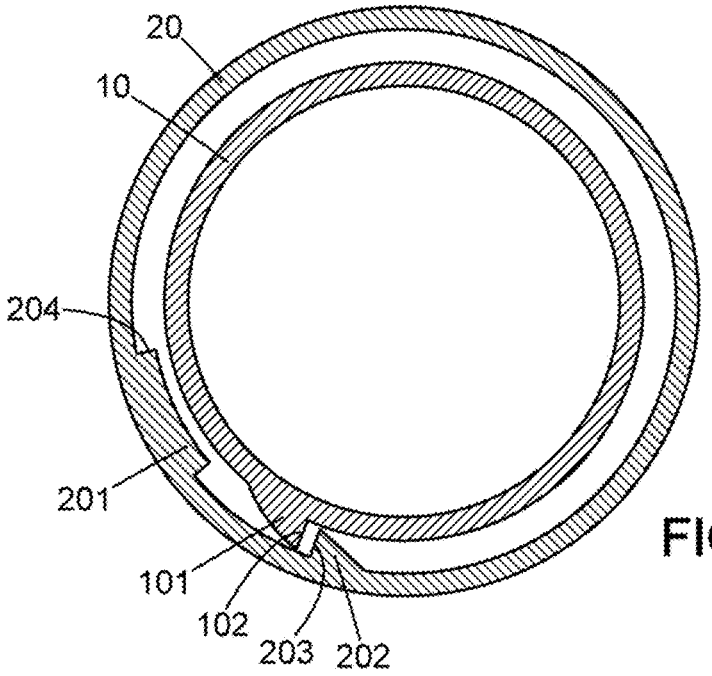

In order to make it possible to avoid unwanted passage into the emptying position from the position for preventing operation, the rotational movement of the dome is limited by a device with complementary stops, shown in FIGS. 5A and 5B.

First, according to a first embodiment, two clean stops, one 102 on the cupola 10 the other 204 on the dome, are provided. These stops, which are for example realized inside a lower part of the dome 20 and on the outside of a facing part of the cupola 10, prevent a rotation of the dome in the direction opposite to the normal direction of use shown in FIGS. 3A to 3C such that it is not possible to turn the dome from the position for preventing operation A directly toward the emptying position C.

Furthermore, to avoid a passage that is too easy from the normal use position called the intermittent actuation position B toward the emptying position C, a hard point is realized in this case by means of two ramps 101 on the cupola and 202 on the dome. These facing ramps will rub against one another during the passage from position B toward position C and prevent unwanted passage into the latter position.

Finally, to prevent the dome returning from the emptying position C toward the use position B, sharp snap-fastening stops 102, 203 terminate the ramps and this, with symmetrical stops 201, creates a housing for the ramp 101 in the emptying position and avoids both a rearward return of the dome and an additional displacement of the dome, thus keeping the dome in the emptying position.

Figure 6:
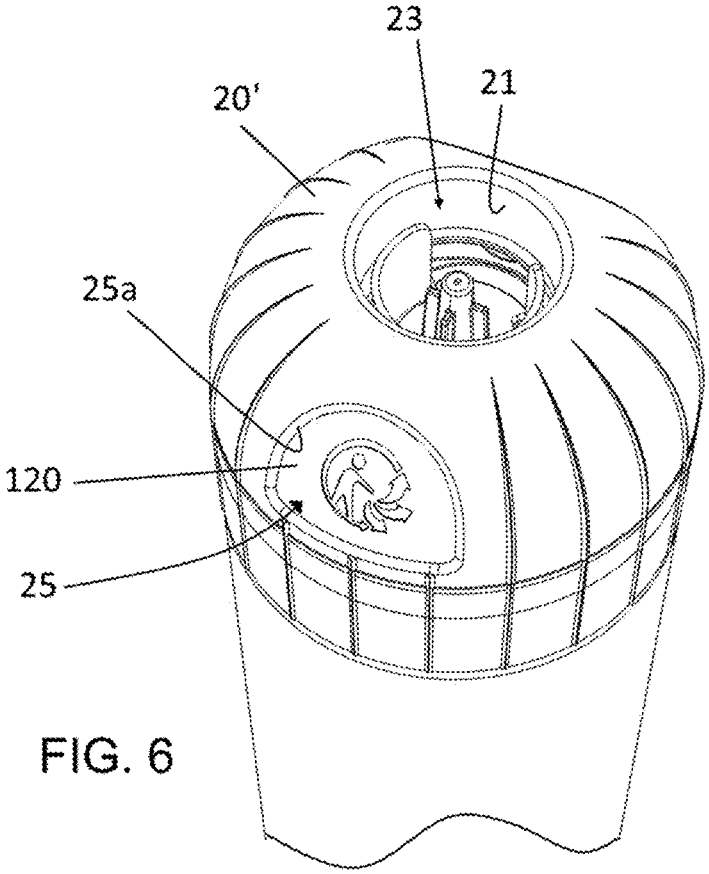
FIG. 6 shows a perspective view of a cap according to a second embodiment.
Figure 7:
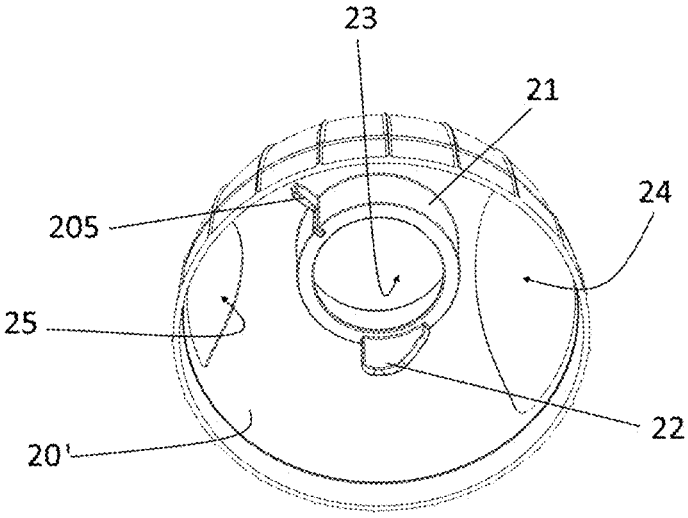
FIG. 7 shows a perspective view from below of a dome of the cap according to the second embodiment.

According to the embodiment shown more particularly in FIGS. 6 to 9, the device can have an activation button 120 realized in the cupola 10, this button being accessible when the dome 20' in FIG. 7 is positioned on the cupola so to allow access to the pushbutton 12 of the diffuser in the position for intermittent actuation of the diffuser.

To do this, the dome 20' has a second opening 25 shown in FIGS. 6 and 7 that allows access to the activation button 120 when the dome is in the position for intermittent actuation of the pushbutton.

Figure 9:
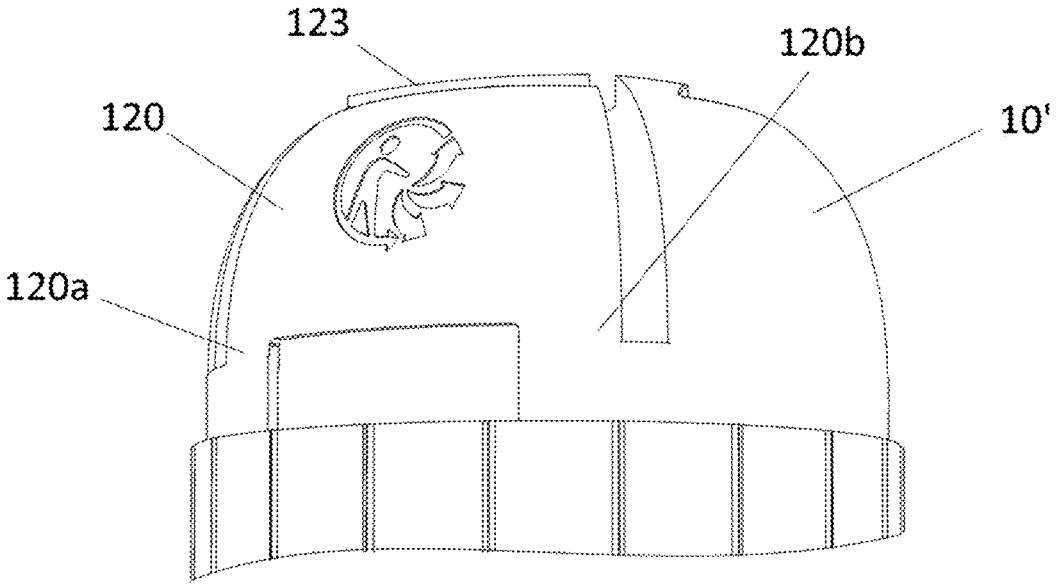
FIG. 9 shows a detail of the cupola according to FIG. 8.

According to FIG. 9, the activation button has a lower part connected to the cupola 10' by a hinge, in this case produced by means of two flexible tabs 120*a*, 120*b*, allowing the activation button to flex angularly when pressed, and this allows the disengagement of a system of stops 121, 205 that is described below.

Figure 8:
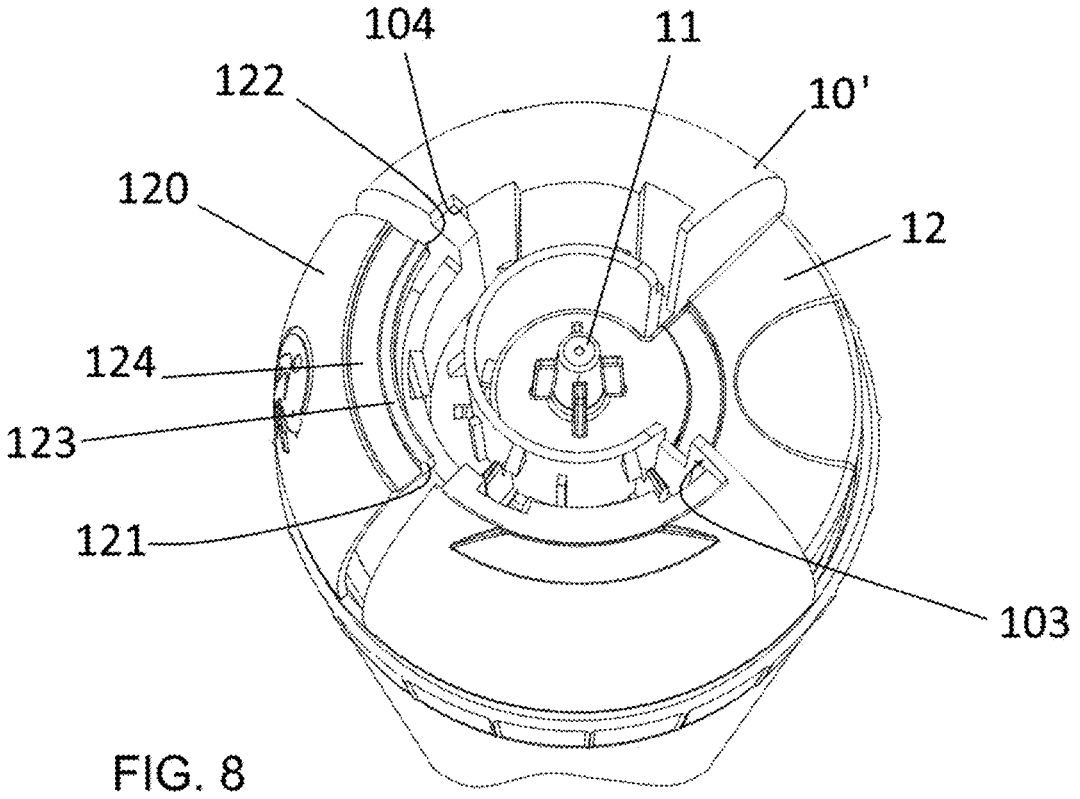
FIG. 8 shows a cupola of the cap according to the second embodiment.

Returning to FIG. 6 that shows the cap on the opposite side from the pushbutton of the diffuser, with the dome in the position for intermittent actuation of the diffuser, the activation button 120 is accessible through the second opening delimited by the wall 25*a*. In this example, the second opening 25 is disposed at 180° from the first opening 24 and likewise the activation button is at 180° from the pushbutton 12 for operating the diffuser as shown in FIG. 8. It should be noted that another relative angular positioning is possible, for example the openings and also the button and the pushbutton can be disposed at 90° from one another.

The dome 20' as seen from below in FIG. 7 will have, in addition to the finger 22 intended to press on the pushbutton 12 in the emptying position, a rigid stop tooth or finger 205 the purpose of which is to prevent displacement of the dome from the intermittent actuation position toward the emptying position without pressing the activation button 120. To do this, according to FIG. 8, the cupola 10' has, as an extension of the activation button 120 in the upper part, a curved groove 124 followed by a curved rib 123. A first end of the curved rib has a first retractable stop 121 complementary to the stop tooth 205 of the dome so as to form said system of stops when the activation button 120 is released, with the dome in the position for intermittent actuation of the diffuser device, whereas when the operator presses the activation button, the stop tooth 205 of the dome escapes the first retractable stop 121 and can pass over the curved rib 123 when the operator turns the dome on the cupola toward the emptying position. It should be noted that the device is thus constituted such that the operator must use both hands to cause the dome to pass from the position for intermittent activation of the pushbutton to the emptying position, and this increases the safety of the device and avoids unwanted passage into the emptying position.

Once the dome is in the emptying position, the second end of the groove constitutes a second retractable stop 122 complementary to the stop tooth 205 of the dome, so as to oppose a return of the dome toward the intermittent activation position.

Furthermore, in the example shown, the cupola is provided with a first and a second end stop 103, 104 that are intended to cooperate with the stop tooth 205 of the dome in extreme rotational positions so as to limit the travel of the dome in rotation. The first end stop 103 cooperates with the stop tooth 205 so as to limit the rotation of the dome in a counterclockwise direction so as to prevent passage from the position for preventing operation toward the emptying position. This operation is the same as the clean stops, 102 on the cupola 10 and 204 on the dome, in FIGS. 5A, 5B. The second end stop 104 cooperates with the stop tooth 205 so as to limit the rotation of the dome in a clockwise direction so as to prevent the dome from leaving the emptying position toward the position for preventing operation.

Of course, the system in which the dome passes from one position to another in a clockwise direction can be reversed so that the dome passes from one position to another in a counterclockwise direction.

Once the dome is in the emptying position, the second retractable stop 122 and the second end stop 104 of the cupola block the stop tooth 205 on both sides, and this opposes a rotation of the dome in both directions (clockwise and counterclockwise). The system described in FIGS. 5A, 5B, in which the lug with ramp 101 and straight stop 102 is held between the stops 201, 203, is in this case retained and improved because the stop tooth 205 has two straight faces, and this makes the blocking between the stops more precise.

In addition, in this configuration in which the openings 24 and 25 of the dome are disposed at 180°, when the dome is in the emptying position, the activation button is hidden by the body of the dome and this prevents the activation button being able to be pressed again so as to retract the retractable stop 122 and leave the emptying position.

It should be noted that it is possible to reinforce the safety of the device by connecting the activation button to the cupola using breakable links in the top part of the button, and this entails applying an additional force so as to bend the activation button and implement the device.

Likewise, a system with a hard point using stops with ramps 101, 202 as shown in FIGS. 5A and 5B can be added in addition to the activation button and the system of stops 121, 205 between the dome and the activation button. The system of stops with ramps will then be placed in the lower part of the dome and of the cupola, for example.

The present disclosure, which makes it possible to render the cans inert, is particularly suitable for cans intended for professional applications in which a specific circuit for collecting empty cans is put in place. In this context, a cap removal operation can be provided so as to recycle, on the one hand, the cans that have been rendered inert in a metal recycling facility instead of processing them as hazardous waste and, on the other hand, the polypropylene caps in a recycling facility for plastic materials.

The present disclosure is not limited to the example shown and, in particular, the actuation means can cooperate with another part of the diffuser device than the pushbutton, a lug cooperating with a lateral boss on the barrel of the diffuser being able in particular to be provided

What is claimed is:

1. A safety cap for an aerosol can, having a cupola at least partially surrounding a diffuser device, said safety cap being provided with a mobile member, which is configured for rotational movement between a first position for preventing operation of the diffuser device, a second position for intermittent actuation of the diffuser device and a third position for emptying the can, said mobile member having means for permanent actuation of the diffuser device in the third position; wherein the diffuser device is provided with a product outlet diffuser and an operating pushbutton and wherein the mobile member includes a rotary dome movable on the cupola, the rotary dome having a diffusion opening at a top of the rotary dome for the product outlet diffuser and a first lateral opening for operable access to the operating pushbutton of the diffuser device at least in the intermittent actuation position.

2. The safety cap as claimed in claim 1, wherein the mobile member and the cupola are provided with complementary stop means opposing a rotation of the rotary dome in a direction from the position for preventing operation toward the emptying position and leaving the rotary dome free to rotate in the direction from the position for preventing operation toward the intermittent actuation position.

3. The safety cap as claimed in claim 1, wherein the mobile member and the cupola are provided with means for realizing a hard point between the intermittent actuation position and the emptying position.

4. The safety cap as claimed in claim 1, wherein the mobile member and the cupola are provided with a non-return device opposing a rotation of the rotary dome from the position for emptying the can toward another position.

5. The safety cap as claimed in claim 1, wherein the cupola has a button for activating said emptying position that is accessible through a second lateral opening of the rotary dome, with the rotary dome in the intermittent actuation position, said third position being activated by disengagement of a system of stops between the rotary dome and the button when the button is pressed, and rotation of the rotary dome beyond the second position for intermittent actuation of the diffuser device as far as said emptying position.

6. The safety cap as claimed in claim 5, wherein said system of stops has, on the button, a first stop configured to be retracted by pressing the button and, under the rotary dome, a stop tooth positioned such that without pressing the button, the first stop blocks the passage of the tooth and such that in the event that the button is pressed, the first stop lets the tooth pass during a rotation of the rotary dome so as to allow the passage of the rotary dome from the intermittent actuation position toward the emptying position.

7. The safety cap as claimed in claim 6, wherein the rotary dome and the cupola are provided with a non-return device opposing a rotation of the rotary dome from the position for emptying the can toward the intermittent actuation position.

8. The safety cap as claimed in claim 7, wherein the non-return device has a second stop configured to be retracted on the button, said second stop cooperating with the stop tooth of the rotary dome so as to, with the button in the released position, oppose a rotation of the rotary dome in the direction from said emptying position toward said intermittent actuation position.

9. The safety cap as claimed in claim 8, wherein the button is hidden by the rotary dome in said emptying position so as to prevent said button being pressed so as to avoid disengagement of the stop tooth and of the second stop and a return of the rotary dome toward said intermittent activation position from said emptying position.

10. The safety cap as claimed in claim 6, wherein the cupola has a first end stop cooperating with said stop tooth, with the rotary dome in the position for preventing operation, so as to oppose a rotation of the rotary dome in a direction from the position for preventing operation toward the emptying position and leave the rotary dome free to rotate in the direction from the position for preventing operation toward the intermittent actuation position.

11. The safety cap as claimed in claim 6, wherein the cupola has a second end stop cooperating with said stop tooth, with the rotary dome in the emptying position, so as to oppose a rotation of the rotary dome in the direction from the emptying position toward the position for preventing operation.

12. The safety cap as claimed in claim 6, having a device with a hard point realized by a stop device with ramps between the rotary dome and the cupola in addition to said system of stops between the rotary dome and the button.

13. The safety cap as claimed in claim 1, wherein the mobile member has a finger directed toward the inside of the cap and configured to press on a part of the diffuser device in the position for emptying the can.

14. The safety cap as claimed in claim 13, wherein the finger is configured to press on the operating pushbutton for operating the diffuser device.

15. The safety cap as claimed in claim 13, wherein the finger includes a bulge extending a lower part of a central hollow shaft of the rotary dome surrounding a diffusion outlet of a diffuser of the diffuser device.

16. An aerosol can having a safety cap as claimed in claim 1.

* * * * *